US005392561A

United States Patent [19]

Henley, Sr.

[11] Patent Number: 5,392,561

[45] Date of Patent: Feb. 28, 1995

[54] SHUTTER ASSEMBLY SYSTEM WITH INDIVIDUALLY REMOVABLE COMPONENTS

[76] Inventor: John B. Henley, Sr., 3985 Palm Dr., San Bernardino, Calif. 92405

[21] Appl. No.: 994,874

[22] Filed: Dec. 23, 1992

Related U.S. Application Data

[63] Continuation-in-part of Ser. No. 820,133, Jan. 13, 1992, abandoned.

[51] Int. Cl.[6] ..... E05F 17/00

[52] U.S. Cl. ..... 49/74.1; 49/92.1

[58] Field of Search ..... 49/74.1, 73.1, 79.1, 49/87.1, 92.1

[56] References Cited

U.S. PATENT DOCUMENTS

| | | | |
|---|---|---|---|
| 1,701,695 | 2/1929 | Paine . | |
| 2,761,185 | 9/1956 | Sherwood . | |
| 2,799,061 | 7/1957 | Hadary . | |
| 3,284,951 | 11/1966 | Shapiro . | |
| 3,371,446 | 3/1968 | Minds, Jr. . | |
| 3,455,057 | 7/1969 | Baird . | |
| 3,932,959 | 1/1976 | Jansons et al. . | |
| 4,655,003 | 4/1987 | Henley, Sr. . | |
| 4,936,048 | 6/1990 | Ruggles . | |
| 4,967,509 | 11/1990 | Storey et al. | 49/74.1 |
| 4,996,793 | 3/1991 | Mazur . | |
| 5,187,896 | 2/1993 | Ross | 49/74.1 |
| 5,191,735 | 3/1993 | Ross | 49/74.1 |
| 5,216,837 | 6/1993 | Cleaver et al. | 49/74.1 |

*Primary Examiner*—Michael J. Milano
*Attorney, Agent, or Firm*—Klein & Szekeres

[57] ABSTRACT

An improved shutter assembly construction includes a pair of vertically disposed side rails or stiles, a plurality of louvers or slats and an elongated member known as a tilt bar or tilt rod. The louvers are provided with a hole or aperture at each end. The side rails or stiles have a plurality of vertically-spaced notches which are configured to fixedly but yet removably receive louver/stile attachment inserts. The louver/stile attachment inserts, preferably made from plastic material, are also mounted to the louvers either by integrally constructed pins or by screws or like fasteners which engage the aperture. The louvers are pivotable relative to the louver/stile attachment inserts and are therefore pivotable relative to the side rails or stiles. The tilt bar or rod is vertically disposed and has a plurality of vertically-spaced notches each of which is configured to fixedly but yet removably receive a louver/tilt bar attachment insert. The louver/tilt bar attachment insert includes a loop which is affixed by a staple (or the like) to the edge of a respective louver or slat. Any louver can be disconnected from the tilt bar by removing the louver/tilt bar attachment insert from its respective notch in the tilt bar. The louver can also be disconnected from the side rails by removing the two louver/stile attachment inserts from their respective notches in the side rails.

21 Claims, 5 Drawing Sheets

FIG. 5
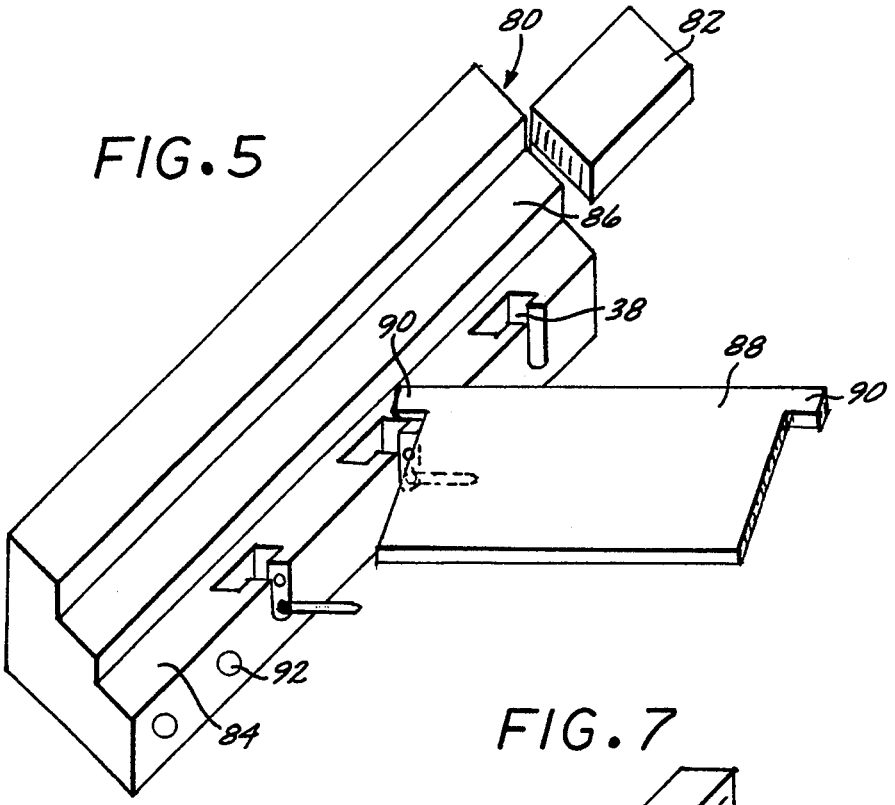
FIG. 7
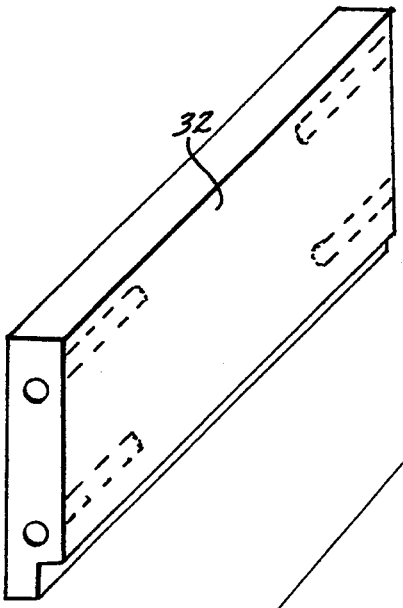
FIG. 6
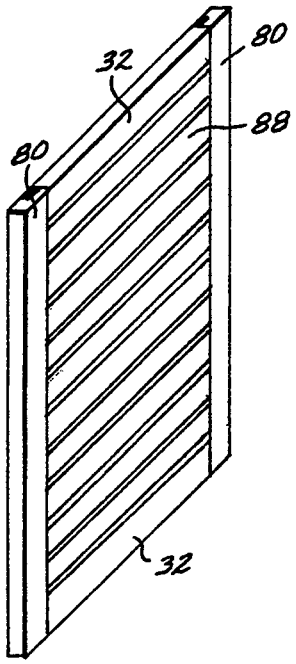
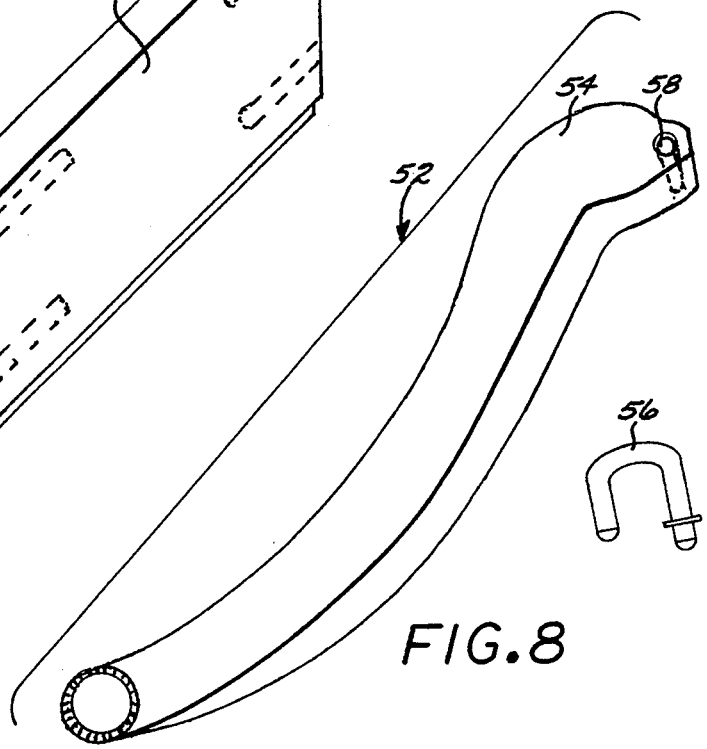
FIG. 8

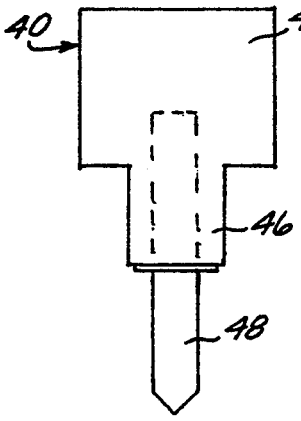
FIG. 9
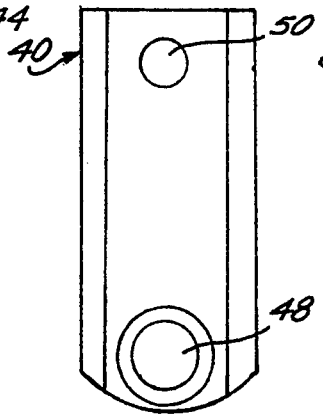
FIG. 10
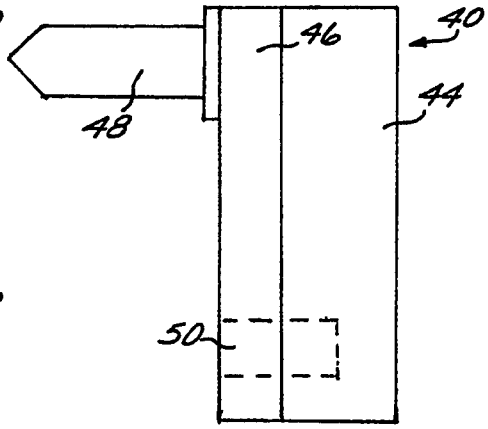
FIG. 11
FIG. 12
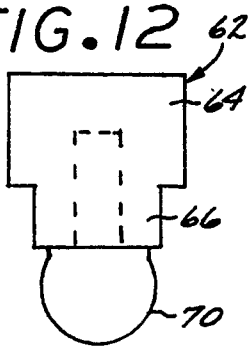
FIG. 13
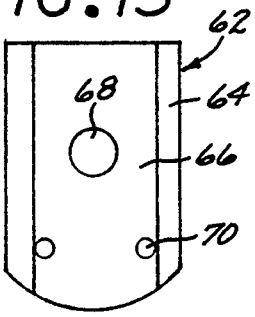
FIG. 14
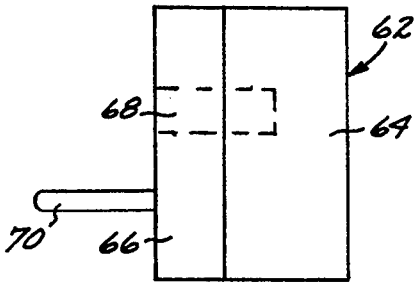
FIG. 15
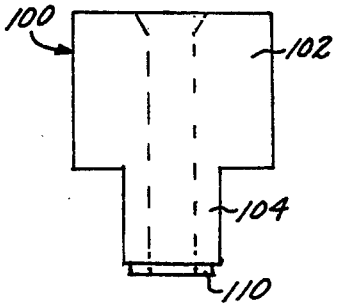
FIG. 16
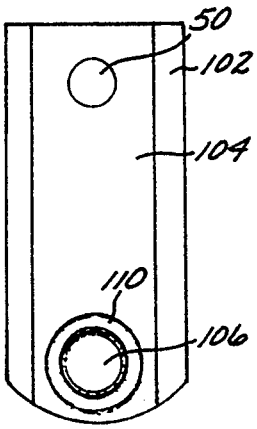
FIG. 17
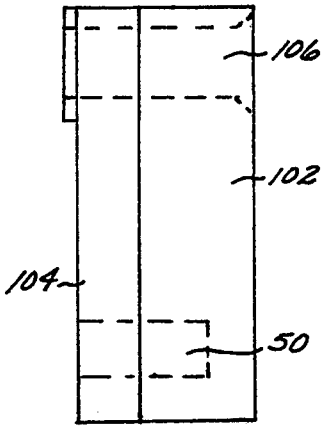
FIG. 18
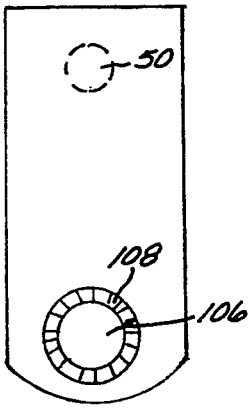

FIG. 19
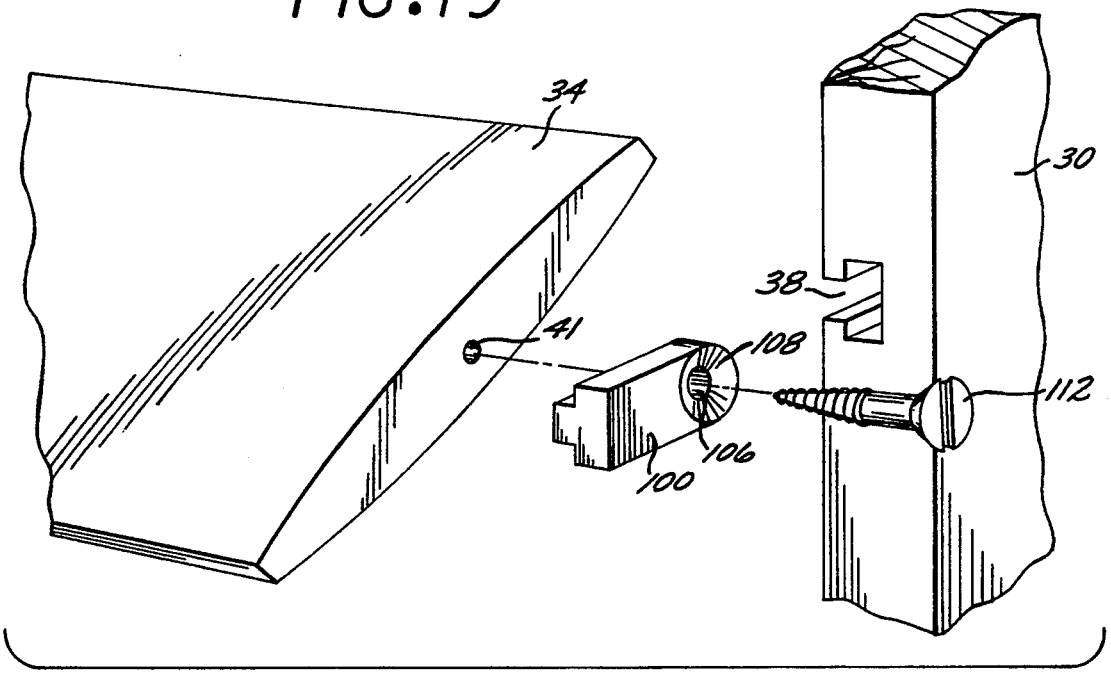
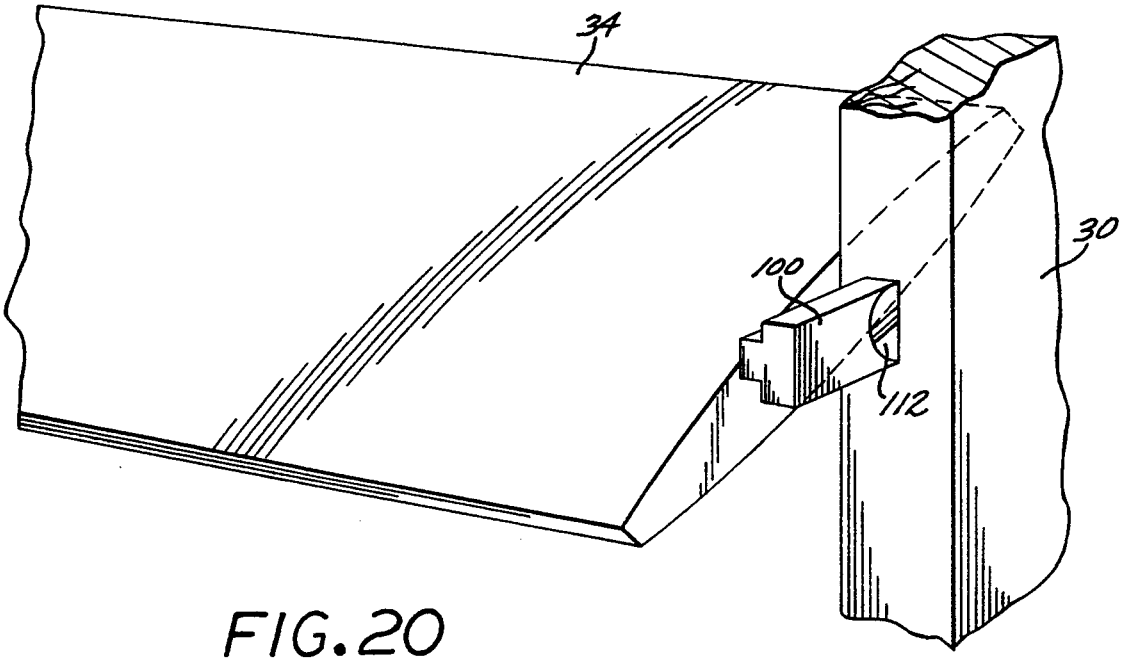
FIG. 20

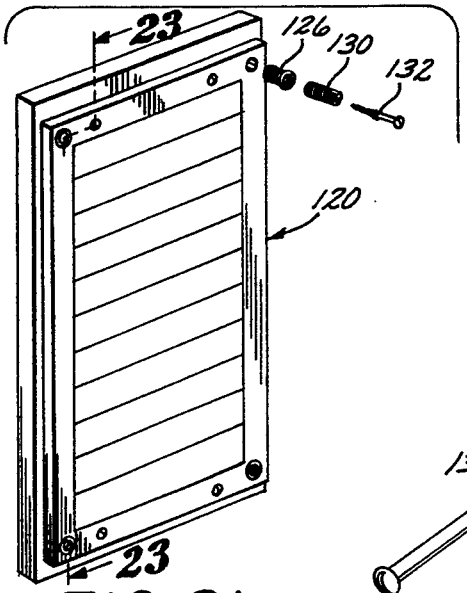
FIG.21
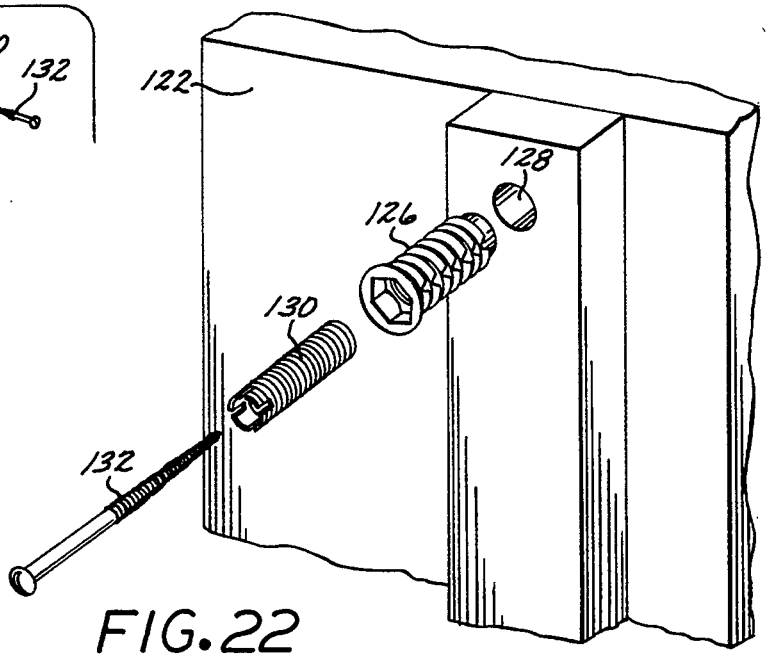
FIG.22
FIG.23
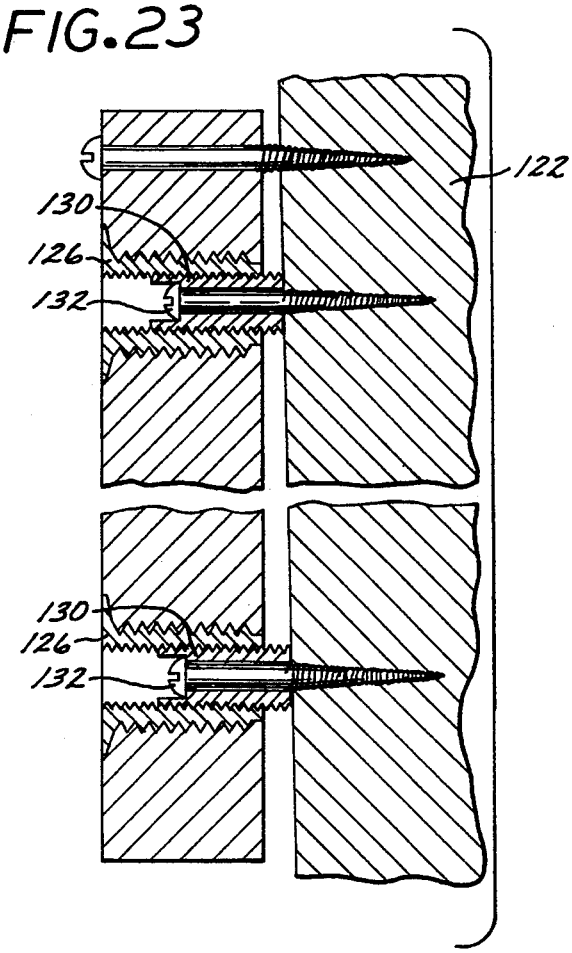
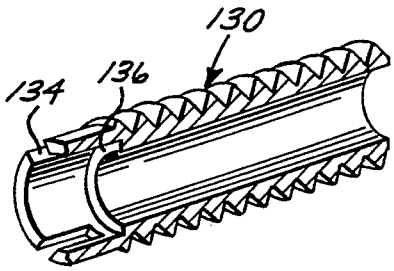
FIG.24

SHUTTER ASSEMBLY SYSTEM WITH INDIVIDUALLY REMOVABLE COMPONENTS

CROSS-REFERENCE TO RELATED APPLICATION

This application is a continuation-in-part of application Ser. No. 07/820,133, filed on Jan. 13, 1992, now abandoned.

BACKGROUND OF THE INVENTION

1. Field of the Invention

The present invention is in the field of shutter or blinds assemblies. More particularly, the present invention is in the field of shutter or blind assemblies of the type wherein individual louvers are readily replaceable without disassembling the entire assembly, and wherein the tilt bar can be easily removed and reassembled relative to the louvers. The present invention is also in the field of improved methods and devices for positionally adjusting, leveling and plumb leveling a shutter frame or like frame relative to a fixed structure.

2. Brief Description of the Prior Art

Shutter and louver assemblies are well known in the prior art, and are described in numerous references, such as U.S. Pat. Nos. 633,013; 1,701,695; 2,761,185; 3,284,951; 3,371,446; 3,455,057; 3,932,959; 4,936,048 and 4,996,793.

Generally speaking all shutters or blinds have a pair of spaced apart, vertical side rails or stiles, which are interconnected substantially on their tops and bottoms with substantially horizontally disposed spreaders. A plurality of louvers or slats are rotatably mounted in the side rails, and appropriate means, such as tilt bar or tilt rod, are provided for opening or closing the louvers or slats in unison. More precisely, the louvers or slats are usually adjustable by manipulation of the tilt bar between a closed position (in which the slats vertically overlap) and an open position (in which the slats are vertically spaced apart). Shutters provided for use on the exterior of a building are sometimes deliberately constructed so as not to have any means (such as a tilt bar) for adjusting the position of the louvers or slats, because on the exterior of a building the louvers may be intended to be closed (vertically overlapped) at all times. Another relatively common feature of shutters or blinds is the provision of a mid-rail, usually disposed in the center (in the vertical direction) of the shutter. The mid-rail is a structural member which interconnects the side rails or stiles, but which, unlike the louvers or slats, is not pivotably mounted so that its position is not adjustable. The several shutter and blind assembly constructions of the prior art primarily differ from one another in the manner in which the louvers or slats are mounted to the side rails, and in the manner in which the adjusting means, such as the tilt bar or tilt rod, are attached to the louvers.

Of particular interest as background to the present invention is U.S. Pat. No. 4,655,003 to Henley, Sr., in which the side rails are provided with horizontally disposed grooves which also have a vertically spaced notch. The louvers or slats have horizontally extending dowels, which are pivotably mounted into the above-noted notches disposed on the side rails. The tilt bar is an elongated vertical member which has a longitudinal channel capable of retaining a second vertical member. A plurality of vertically-spaced transverse slots in the elongated member receive an eyelet retained in the slot by the second vertical member. The eyelets are attached to loops affixed (for example stapled) to the edge of the louvers or slats. The shutter assembly of this patent reference allows, at least in principle, the removal of individual louvers or slats from the assembly for such purposes as replacement or repair. This shutter assembly however, also suffers from certain disadvantages, which include its complexity of construction, and the bulkiness of the tilt bar. Moreover, assembly and use of this shutter assembly is not problem free, the components are hard to assemble, and malfunction during assembly and use is more common than would be desired.

U.S. Pat. No. 2,799,061 to J. Hadary is also of interest. In the shutter assembly of this reference the louvers or slats have dowels which are inserted into apertures provided in an extra side strip, which is itself mounted to the side rail or stile of the shutter assembly. The tilt bar of this reference has a plurality of staples each of which engages a screw in type hook inserted into the edge of the louvers.

In spite of the availability of relatively large number of somewhat differing prior art shutter or blinds constructions, there is still a significant need for improvement in this field. Particularly, there is a significant need for a shutter and blind assembly, which is relatively simple to construct, simple to assemble without major mechanical skill and tools, sturdy and reliable in operation, has an uncluttered esthetic appearance, and which permits easy assembly and reassembly of the entire tilt rod (for example for the purposes of thorough cleaning of the louvers) and of individual louvers or slats (for example for the purpose of replacement or repair). The present invention provides such a shutter or blind assembly.

SUMMARY OF THE INVENTION

It is an object of the present invention to provide a shutter or blinds assembly which is relatively easy to manufacture, and easy to assemble without major mechanical skill or complicated tools.

It is another object of the present invention to provide a shutter or blinds assembly which is reliable and sturdy in operation.

It is still another object of the present invention to provide a shutter or blinds assembly wherein the tilt bar can be easily disconnected and reconnected either to all of the louvers, or to any individual louver.

It is a further object of the present invention to provide a shutter or blinds assembly wherein each louver or slat can be easily disassembled and reassembled without affecting the rest of the louvers.

The foregoing and other objects and advantages are attained by a shutter assembly construction having a pair of vertically disposed side rails or stiles, a plurality of louvers or slats and a tilt bar or tilt rod. The louvers are provided with a hole or aperture at each end. The side rails or stiles have a plurality of vertically-spaced notches which are configured to fixedly but yet removably receive louver/stile attachment inserts. The louver/stile attachment inserts are also mounted to the louvers either by pins which extend from the louver/stile attachment insert into the respective aperture of the louver, or by screws or like fasteners which engage the aperture. The louvers are pivotable relative to the louver/stile attachment inserts mounted thereto on each side of each louver, and are therefore pivotable relative to the side rails or stiles.

The tilt bar or rod is vertically disposed and has a plurality of vertically-spaced notches each of which is configured to fixedly but yet removably receive a louver/tilt bar attachment insert. The attachment insert includes a loop which is affixed by a staple (or the like) to the edge of a respective louver or slat.

In order to disassemble a louver from the tilt bar only the louver/tilt bar attachment insert needs to be removed from the respective notch in the tilt bar in which the insert is seated. Thereafter, in order to disassemble a louver from the side rails or stiles only the two louver/stile attachment inserts need to be removed from the respective notches in the stiles in which the respective inserts are seated.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 5 is a perspective view of a side bar or stile and louver of a second preferred embodiment of the present invention;

FIG. 6 is a perspective view of the second preferred embodiment of a window shutter assembly of the present invention;

FIG. 7 is a perspective view of a horizontally mounted spreader bar in accordance with the second preferred embodiment;

FIG. 8 is an exploded perspective view of a tool used in connection with the disassembly of the shutter of the present invention;

FIGS. 9, 10 and 11 are plan views of a louver/stile attachment insert in accordance with the present invention;

FIGS. 12, 13, and 14 are plan views of a louver/tilt bar attachment insert in accordance with the present invention;

FIGS. 15, 16, 17 and 18 are plan views of a second embodiment of a louver/stile attachment insert in accordance with the present invention;

FIG. 19 is an exploded perspective view showing attachment of a louver to a stile utilizing the second embodiment of the louver/stile attachment insert;

FIG. 20 is a perspective view showing attachment of a louver to a stile with the second embodiment of the louver/stile attachment insert;

FIG. 21 is a schematic perspective view showing attachment of a shutter assembly to an underlying support frame;

FIG. 22 is another schematic partial perspective view showing attachment of a shutter assembly to an underlying support frame;

FIG. 23 is a cross-sectional view taken on lines 23,23 of FIG. 21; and FIG. 24 is a perspective view of an interior sleeve utilized for affixing a shutter assembly to an underlying support frame in accordance with the present invention.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Referring now to FIGS. 1–4 of the appended drawings, a first preferred embodiment of the shutter or blinds assembly is disclosed in detail. The first preferred embodiment is an interior shutter, that is to say it is designed to be used primarily in the interior of a building structure. It is noted at the outset of the present description that certain terms, which are commonly used interchangeably in the art pertaining to shutters and their component parts, are also used interchangeably throughout the present application, Thus, the term "shutter" is interchangeable with "blinds"; "side rail" is interchangeable with "stile"; "louver" is interchangeable with "slat"; and "tilt bar" is interchangeable with "tilt rod". No distinction is intended in this application when only one of the above-noted interchangeable or equivalent terms is used.

The shutter assembly of the first preferred embodiment includes a pair of vertically spaced side rails 30, and a pair of horizontally spaced spreaders 32. As is well understood in the art, the side rails 30 and the spreaders 32 jointly form a substantially rectangular frame and define the dimensions of the shutter assembly.

A plurality of substantially flat louvers or slats 34 are mounted between the side rails 30. A tilt bar 36 interconnects the louvers or slats 34 and allows them to be moved for being opened or closed in unison. Detailed construction of these component parts are described below with particular emphasis to novel features of the invention.

Figure 3:
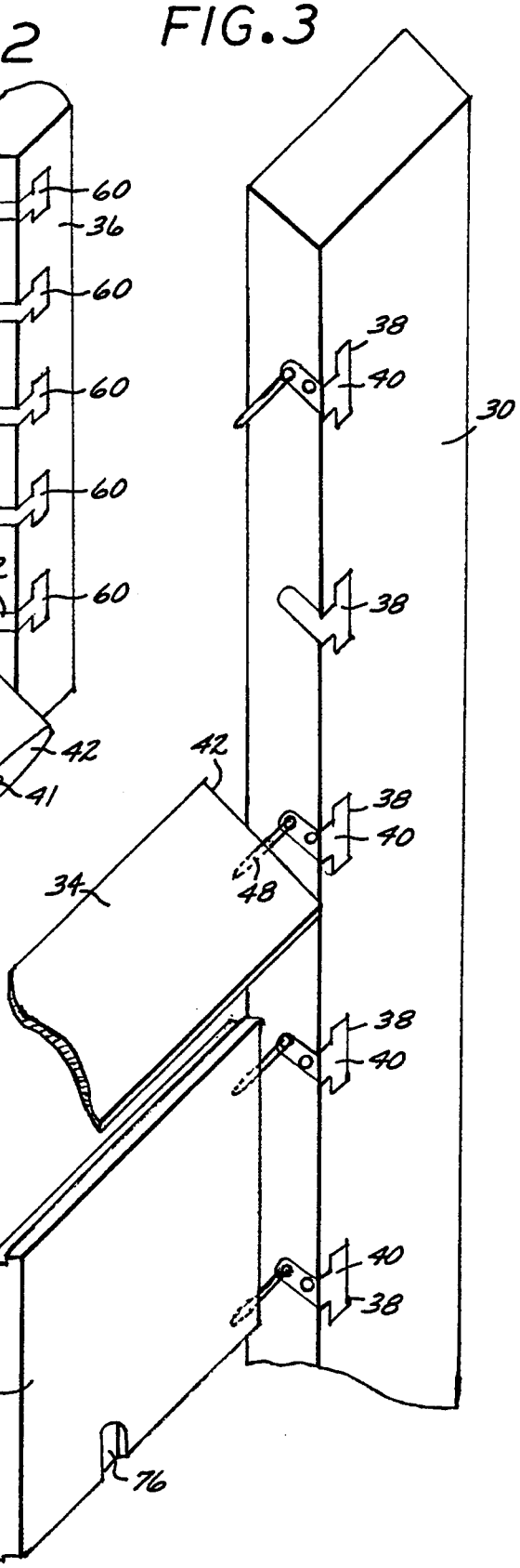
FIG. 3 is perspective view of a side rail or stile attached to a louver and to a mid-rail, in accordance with the first preferred embodiment.
Figure 4:
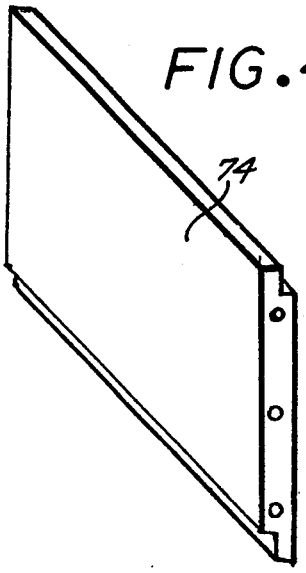
FIG. 4 is a perspective view of the mid-rail of the first preferred embodiment.

FIG. 3 reveals the mounting of the louvers 34 to the side rails 30, which is a significant novel feature of the present invention. Thus, the side rail 30 is an elongated member of substantially rectangular cross-section. Notches 38 of specific configuration are vertically spaced in the side rail 30 and aligned with one another in the two parallel disposed side rails 30. FIG. 3 shows that in the preferred embodiment the notches 38 extend rearward to the approximate center of the side rail 30. Generally speaking, they may terminate somewhere between the longitudinal middle of the side rail 30 and the rearward edge thereof, depending on the thickness of the side rail body.

Each notch 38 of the side rail 30 is configured to removably but yet fixedly receive and firmly seat therein a louver/side rail attachment insert 40 having a configuration complementary to the notch 38. The ends 42 of the louvers 34 include a hole or aperture 41 into which the louver/side rail attachment insert 40 is rotatably mounted. Referring now specifically to FIGS. 9, 10 and 11 of the appended drawings, the louver/side rail attachment insert 40 is shown to have a main body which itself comprises a wider base 44 and a narrower step-up section 46. A pin 48 extends outwardly from the step-up section 46. The entire body, that is the base 44 and the step-up section 46 of the louver/side rail attachment insert 40 is slightly tapered so that it is somewhat narrower at the bottom where the pin 48 is attached than at the top. A blind aperture or hole 50 is also incorporated in the louver/side rail attachment insert 40.

In order to attach the louver 34 between the parallel disposed side rails 30 when the shutter of the invention is assembled, the pin 48 of the louver/side rail attachment insert 40 is inserted into the corresponding aperture 41 of the louver 34. Relative dimensions of the pin 48 and the aperture 41 are such that the pin 48 is friction fitted in the aperture 41, and yet the louver 34 is rotatable relative to the pin 48. There is sufficient self-tension (friction) between the pin 48 and the louver 34 that the louver 34 remains in any position to which it is momentarily adjusted in the assembled shutter.

To continue with the mounting of the louver 34 to the side rail or stile 30, the louver/side rail attachment inserts 40 (which have already been mounted to the louver 34) are inserted into the opposite notches 38 of the two side rails 30. Again, the relative dimensions of the louver/side rail attachment inserts 40 and the notches 38 are such that the insert 40 has a firm friction fit in the notch 38. Tapering of the insert 40 in the above described manner, and the complementary tapering of the notch 38 further insures a firm fit, and yet allows for removability of the insert 40 from the notch 38.

The louver/side rail attachment insert 40 is advantageously manufactured from plastic by a plastic molding or like procedure. The insert 40 of the preferred embodiments is made from polyamides (nylon). In this connection it is noted that all component parts of the present invention, except those which are specifically mentioned otherwise, are preferably made from wood, utilizing well known wood-working techniques and procedures. For example, the notches 38 are formed in the side rails 30 by routing or similar wood-shaping procedures. Nevertheless, those skilled in the art will recognize that other materials, such as metals or plastics can also be utilized to make those parts of the shutter of the present invention which in the herein-described preferred embodiments are made from wood.

In order to remove a louver 34 from its position affixed between the two parallel side rails 30 in the shutter assembly of the present invention, the two louver/side rail attachment inserts 40 which hold the louver 34 in place, must be removed from the notches 38 in which they are seated. This is most advantageously accomplished by utilizing the tool 52 shown in FIG. 8 of the appended drawings. The tool 52 comprises an elongated handle 54 and a substantially U-shaped metal prong 56 which is seated in an aperture 58 substantially at one end of the handle 54. The louver/side rail attachment insert 40 is removed from its notch 38 with the tool 52 by inserting the free end of the prong 56 into the aperture 50 incorporated in the louver/side rail attachment insert 40 for that purpose, and prying with the tool 52 in an upwardly direction while the handle 54 of the tool 52 rests on the side rail 30. The elongated shape and recessed end of the tool handle 54 helps to keep the side rail 30 from being dented or marred by use of the tool 52.

Figure 1:
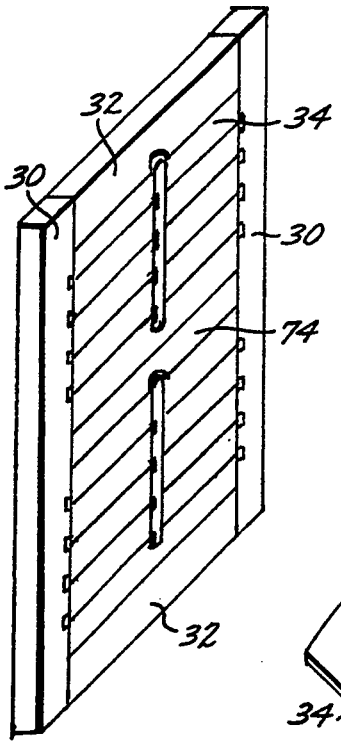
FIG. 1 is a perspective view of a first preferred embodiment of a window shutter assembly of the present invention.

Inspection of the drawing figures and particularly of FIGS. 1 and 3 reveal that in the herein described first preferred embodiment the two side rails 30 comprise pieces which are not only mirror images of one another but are also superimposable. Consequently, the two side rails are interchangeable with one another, thereby reducing manufacturing and assembly costs.

Figure 2:
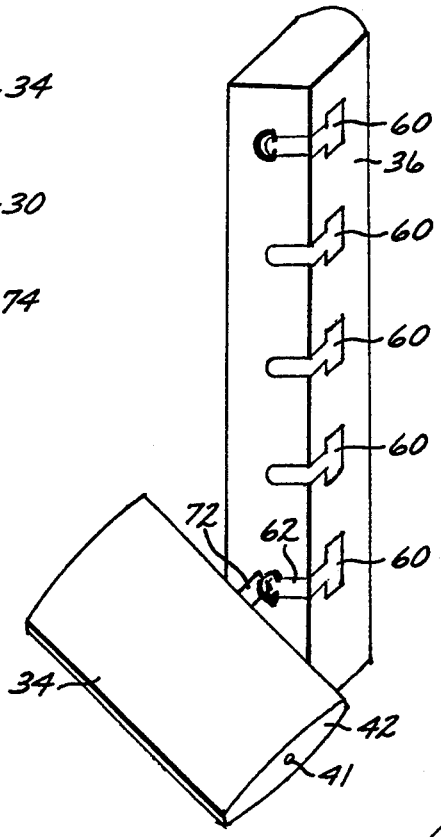
FIG. 2 is a perspective view of a tilt rod and an attached louver in accordance with the first preferred embodiment.

Referring now primarily to FIG. 2, attachment of the louvers or slats 34 to the tilt bar or tilt rod 36 is shown. The tilt bar 36 is an elongated member of substantially rectangular cross-section, which has a plurality of vertically spaced notches 60. The notches 60, similar to the notches 38 of the side rails 30, may be formed by routing or like wood-working techniques. The notches 60 are configured to be complementary to, and to fixedly and yet removably receive louver/tilt bar attachment inserts 62. These inserts 62 are shown in more detail in FIGS. 12, 13 and 14. Thus, each louver/tilt bar attachment insert 62 has a body which includes a base 64 and a step-up portion 66. An aperture or hole 68 is formed in the insert 62 for the same purpose served by the aperture 50 in the louver/side rail attachment insert 40, namely to allow removal of the insert 62 from the notch 60 by the use of the tool 52. The louver/tilt bar attachment insert 62 also includes a loop 70 which projects outwardly, in a direction parallel with the axis of the aperture 68. The body of the insert 62 is also tapered slightly (like the insert 40) in order to facilitate insertion and removal of the insert 62 from the notch 60 in the tilt bar 36. The louver/tilt bar attachment insert 62, like the louver/side bar attachment insert 40, is also preferably made from plastic, most preferably from polyamide (nylon). When each individual louver 34 is mounted to the shutter assembly, the loop 70 of the louver/tilt bar attachment insert 62 is first affixed to the edge of the louver 34 by a loop forming member, such as a metal staple 72, shown on FIG. 2. The staple 72 is driven into the wood material of the louver 34 by a staple gun (not shown), or other appropriate tool. Thereafter, the louver/tilt bar attachment insert 62 is pressed into the appropriate notch 60 of the tilt bar 36. There the insert 62 is seated firmly. The process is reversed, that is, the louver 34 is disconnected from the tilt bar 36 by removing the louver/tilt bar attaching insert 62 from the notch 60 by prying the insert 62 out with the tool 52.

The first preferred embodiment of the interior shutter assembly of the present invention includes a mid-rail 74, which is a board that interconnects the side rails 30 substantially in the center of the shutter assembly. The maid-rail 74 can be mounted to each side rail 30 by two inserts 40 of the type described above for mounting the louvers 34 to the side rails 30, and for this reason the mid-rail 74 is not pivotable relative to the side rails 30. Nevertheless, the mid-rail 74 is also removable from the shutter assembly just like the individual louvers 34 are removable, and can even be replaced, if desired, by louvers 34. The notch 76 shown in the mid-rail 74 in FIG. 3 serves to accommodate the tilt bar 36 which is mounted below the mid-rail 74.

The ease of assembly and disassembly of the shutter assembly of the present invention should be readily apparent to those skilled in the art in light of the foregoing disclosure. In this regard it is emphasized that the tilt bar 36 may be disconnected from any individual louver 34 and the louver 34 may be removed from the side rails 30, without affecting the other louvers 34. This can be done for any purpose, such as replacement or repair. In addition the tilt bar 36 may be readily disconnected (and thereafter reconnected) to the entire assembly of louvers 34, for any purpose, for example for unimpeded cleaning of the louvers 34.

It should be further noted in connection with the first preferred embodiment, that the tilt bar 36 can accommodate insertion of the louver/tilt bar attachment inserts 62 from either side, thus either end of the tilt bar 36 can be placed up or down in the shutter assembly.

Referring now to FIGS. 5, 6 and 7, a second preferred embodiment of the shutter assembly of the present invention is disclosed. This embodiment is designed to be used primarily as an exterior shutter where it is desired to keep the louvers in a permanently closed position, and where, therefore, there is no requirement for means, such as a tilt bar, for adjusting the position of the louvers. As it can be readily understood from inspection of FIGS. 5, 6 and 7, the shutter assembly of the second preferred embodiment also includes a pair of vertically disposed side rails 80 which are interconnected with a pair of horizontally disposed spreaders 32. One spreader 32 of the second preferred embodiment is specifically shown in FIG. 7. The spreader 32 is attached to the side rails or stiles 80 by dowels, as is schematically indicated in FIG. 7. The dowels or pins (not specifically shown) may be wood or plastic. Of course, other conventional means for attaching the spreaders 32 to the side rails 80 can also be utilized.

The side rails 80 of the second preferred embodiment differ from the side rails 30 of the first preferred embodiment in that the side rails 80 are designed to accommodate a louver retention strip 82, which is best shown in FIG. 5. For this purpose the side rail 80 is formed to have two step-up portions, the first of which provides a first surface 84 where the notches 38 for seating the louver/stile attachment inserts 40 are placed. The louver retention strip 82 is affixed (by nails or other conventional attachment means) to the second step-up surface 86. When the louver retention strip 82 is mounted to the side rail or stile 80 (after the louvers had been attached to the side rail), then the upper surface of the retention strip 82 is flush with the thickest portion of the side rail 82, so that an overall substantially rectangular, pleasing and uncluttered appearance is presented. Louvers or slats 88 of the second preferred embodiment differ from the louvers or slats 34 of the first preferred embodiment in that the louvers 88 include a pair of ears 90 which are accommodated between the retention strip 82 and the first surface 84 of the side rail or stile 80. The side rail or stile 80 depicted in FIG. 5 also has holes 92 to accommodate dowels or pins (not shown) which attach the spreader 32.

Referring now to FIGS. 15–18, an alternative embodiment of the louver/stile attachment insert 100 is disclosed. This particular embodiment of the insert 100 has a somewhat elongated and tapered body comprising a base 102 and a narrower step-up section 104. It also has a hole or aperture 50 for the purpose of receiving the tool 52 when the insert 100 is to be removed from the notch 38 in which it is seated. The foregoing features and parts of the insert 100 are similar to, or identical with the corresponding features of the louver/stile attachment insert 40. The louver/stile attachment insert 100, however has no pin to attach it to the louver 34. Instead, a transverse hole or aperture 106 is provided in the insert 100. One end 108 of the hole 106 is countersunk as shown on FIG. 18, the other end has a raised periphery or rim 110, as is shown on FIGS. 15, and 16.

Mounting of the insert 100 to the louver 34 and to the stile 30 with a wood screw 112 is shown in FIGS. 19 and 20. The wood screw 112 attaches the insert 100 to the louver 34, and the head of the screw 112 is accommodated in the countersunk end 108 of the hole 106. The tension or friction of the insert 100 relative to the louver 34 can be finely adjusted by turning of the screw 112. The rest of the insert 100 is seated in the notch 38 of the side rail or stile 30 in the manner described for the first preferred embodiment.

Referring now to the schematic views of FIGS. 21–23, an improved mode of affixing the shutter assembly 120 of the present invention to a building structure is disclosed. More specifically, FIGS. 21–24 depict a system and method whereby the shutter assembly 120 of the present invention, or any other rectangular or like frame, can be attached and precisely adjusted ("plumb leveled") relative to a wall of a building structure, or to a wooden frame or support being part of or attached to a building structure. Specifically, the board 122 schematically depicts a frame or wooden wall, or like structural member, to which the shutter assembly 120 of the present invention is attached. It should be understood in connection with FIGS. 21–24 that with such appropriate modifications which will readily become apparent to those skilled in the art in light of the present disclosure, a window or a door frame, or any like structure, can be attached and "plumb-leveled" relative to a support member, such as the frame or board 120. Moreover, with appropriate modifications, instead of a wooden frame or board 120 the attachment can also be made to a concrete wall (not shown).

Thus, in order to affix and precisely adjust ("plumb level") the exemplary shutter assembly 120 in accordance with the invention, a screw insert sleeve 126 is threaded on the outside with threads appropriate for driving it into wood, and also has interior threads. As is shown in the drawings, in the preferred embodiment four screw insert sleeves 126 are used in the herein described example to "plumb level" the shutter assembly, although it will be readily apparent to those skilled in the art that a larger number of screw insert sleeves 126 could also be used, and may be necessary depending on the size of the shutter assembly (or other item) which is affixed and plumb leveled relative to the underlying frame 122.

A second interior sleeve 130 which is threaded on the outside is driven into each screw insert sleeve 126. As is shown on the drawing figures, the interior sleeve 130 is threaded into the sleeve insert 126 until it abuts against the against the underlying frame 122. A wood screw 132 is inserted into each interior sleeve 130 and is driven into the underlying frame 122 to keep the shutter assembly 120 in position. The wood screws 132 initially hold the shutter assembly 120 only loosely for the duration of the herein described adjustment. To continue with the adjustment, the four interior sleeves 130 are turned in or out as necessary until satisfactory "plumb leveling" of the shutter assembly is obtained. Thereafter, the wood screws 132 are tightened to fixedly hold the shutter assembly 120 in place. FIG. 24 shows the interior sleeve 130 in detail, depicting a slot 134 for receiving a screw driver (not shown) and an interior shoulder 136 against which the wood screw 132 is driven and held.

It is noted in connection with the foregoing description, that a perimeter frame (not shown) for a hinged shutter is advantageously anchored and plumb leveled in the above-described manner, and that the above described plumb leveling is specifically suitable for that purpose.

What has been described above is a novel shutter assembly, and a system and method for mounting a shutter assembly like object, such as a window frame or door frame to an underlying support member. Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A shutter assembly, comprising:

a pair of substantially parallel side rails;

a pair of substantially parallel spreaders, the spreaders being attached to the side rails, whereby the side rails and spreaders form a substantially rectangular frame, the side rails having a plurality of vertically spaced side rail notches formed in the sides thereof, the side rail notches of one side rail being aligned with the side rail notches of the other side rail;

a plurality of louvers; and a plurality of individually removable side rail attachment inserts, each side rail attachment insert being individually removable without removal of a side rail, each of the side rail attachment inserts dimensioned and configured to be complementary with and to fit firmly in one of the side rail notches, each side rail attachment insert further having means for pivotably attaching the side rail attachment insert to one end of one louver, whereby the louvers are mounted between the pair of parallel side rails with said side rail attachment inserts so as to allow the louvers to be pivoted with respect to the side rails without movement of the side rail inserts.

2. The shutter assembly of claim 1 wherein each louver has at least one aperture in each end which is adjacent to a side rail, and wherein the means for pivotably attaching the side rail attachment insert to one side of one louver comprises a pin affixed to the side rail attachment insert, said pin being configured and dimensioned to be friction fitted in the aperture of the louver.

3. The shutter assembly of claim 1 wherein each louver has at least one aperture in each end which is adjacent to a side rail, and wherein the means for pivotably attaching the side rail attachment insert to one side of the louver comprises a screw affixing the side rail attachment insert to the aperture.

4. The shutter assembly of claim 1 wherein the side rail attachment insert comprises plastic material.

5. The shutter assembly of claim 1, wherein the plurality of notches is a first plurality of notches, the assembly further comprising means for simultaneously adjusting the position of a plurality of louvers between a substantially vertically aligned, closed position and a substantially horizontally aligned open position, the means for adjusting including an elongated member having a second plurality of notches and a plurality of individually removable louver attachment inserts each dimensioned and configured to be complementary with and to fit firmly in one of the second plurality of notches, each louver attachment insert also being affixed to one louver.

6. The shutter assembly of claim 5 wherein the louver attachment insert includes a loop, and wherein said loop is affixed to one louver by a staple.

7. The shutter assembly of claim 5 wherein the louver attachment insert comprises plastic material.

8. In a shutter assembly having a pair of substantially parallel side rails; a pair of substantially parallel spreaders, the spreaders being attached to the side rails, whereby the side rails and spreaders define a substantially rectangular frame; and a plurality of louvers mounted between the side rails, the improvement comprising:

a first plurality of vertically spaced apart notches formed in each of the side rails, each of said first plurality of notches in one of the side rails being horizontally aligned with a corresponding notch in the opposite side rail; and a plurality of side rail attachment inserts, each dimensioned to fit firmly and removably in one of the first plurality of notches, each rail attachment insert being individually removable without removal of a side rail and each rail attachment insert having means for pivotably attaching said rail attachment insert to one louver so as to allow the louvers to be pivoted without movement of the rail attachment insert.

9. The improvement of claim 8 wherein the side rail attachment inserts comprise plastic material.

10. The improvement of claim 8 wherein the shutter assembly further comprises means for simultaneously adjusting the position of a plurality of louvers between a substantially vertically aligned, closed position and a substantially horizontally aligned open position, the means for adjusting including an elongated member and wherein the improvement further comprises a second plurality of vertically spaced notches formed in the elongated member and a plurality of individually removable louver attachment inserts each dimensioned and configured to be complementary with and to fit firmly in one of the second plurality of notches, each louver attachment insert also being affixed to one louver.

11. The improvement of claim 10 wherein the louver attachment inserts comprise plastic material.

12. The improvement of claim 10 wherein each side rail attachment insert comprises a body of unitary construction, said body having a pin protruding therefrom and wherein the pin comprises the means for pivotably attaching the side rail attachment insert to one louver.

13. The improvement of claim 12 wherein each louver attachment insert comprises a body having a loop protruding therefrom, the loop being affixed to one louver.

14. The improvement of claim 13 wherein the loop of the louver attachment insert is affixed to the louver by a staple.

15. The improvement of claim 13 wherein each side rail attachment insert includes an aperture, the aperture serving as means for engaging a tool for removing the side rail attachment insert from the respective notch of the side rail.

16. The improvement of claim 15 wherein each louver attachment insert includes an aperture, the aperture serving as means for engaging a tool for removing the louver attachment insert from the respective notch of the elongated member.

17. The improvement of claim 16 wherein the side rail attachment inserts and the louver attachment inserts consist of polyamide material.

18. A shutter assembly, comprising:

a pair of substantially parallel side rails;

a pair of substantially parallel spreaders attached to the side rails, whereby the side rails and spreaders form a substantially rectangular frame, the side rails having a plurality of vertically spaced side rail notches formed in the sides thereof, the side rail notches of one side rail being aligned with the side rail notches of the other side rail;

a plurality of louvers;

a plurality of side rail attachment inserts, each dimensioned and configured to be received in one of the side rail notches and each side rail attachment insert being individually removable without removal of a side rail; and means for pivotably attaching each side rail attachment insert to an end of one of the louvers with an adjustable amount of friction therebetween, whereby the louvers are pivotably mounted between the pair of parallel side rails with said side rail attachment inserts so as to allow the louvers to be pivoted without movement of the rail attachment insert.

19. The shutter assembly of claim 18, wherein the means for pivotably attaching comprises:

a threaded element adjustably extending through the insert and into the end of the louver.

20. The shutter assembly of claim 18, wherein each of the side rail inserts is individually removable from the notch in which it is received.

21. The shutter assembly of claim 18, further comprising:

tilt bar means for simultaneously pivoting at least some of the plurality of louvers between a closed position and an open position, the tilt bar means including a plurality of vertically spaced tilt bar notches;

a plurality of individually removable louver attachment inserts each dimensioned and configured to be received in one of the plurality of tilt bar notches; and means for attaching each louver attachment insert to a louver.

* * * * *